United States Patent [19]

Glendinning

[11] 4,255,864

[45] Mar. 17, 1981

[54] SUN CLOCK

[76] Inventor: Scott R. Glendinning, c/o Glendinning Companies, Inc., 1 Glendinning Pl., Westport, Conn. 06880

[21] Appl. No.: 915,949

[22] Filed: Jun. 15, 1978

[51] Int. Cl.[3] ..... G04B 49/00

[52] U.S. Cl. ..... 33/270

[58] Field of Search ..... 33/269, 270, 272, 275

[56] References Cited

U.S. PATENT DOCUMENTS

| | | | |
|---|---|---|---|
| 783,245 | 2/1905 | Clarke | 33/270 |
| 825,319 | 7/1906 | Hewitt | 33/270 |
| 933,556 | 9/1909 | Hansen | 33/270 |
| 2,207,195 | 7/1940 | Guadet | 33/270 |
| 2,536,328 | 1/1951 | Triplett | 33/270 |
| 3,486,234 | 12/1969 | Waterman | 33/270 |
| 3,786,570 | 1/1974 | Daries | 33/270 |

OTHER PUBLICATIONS

Advertising Sheet from Heritage Workshop for "Sun Clock", fall, 1977.

*Primary Examiner*—Steven L. Stephan

*Attorney, Agent, or Firm*—Cooper, Dunham, Clark, Griffin & Moran

[57] ABSTRACT

A solar time indicating device in the form of an elongated box-like structure having a slot in one of its side faces for passing sunlight. A light image or line formed by the illuminated slot falls on a translucent side face, containing a proportionately expanded linear time index, disposed opposite the slotted face. The position of the leading edge of the light image along the time index or scale indicates solar time when the parallel, slotted and scale faces are tilted at the angle of latitude and the long axis of the box is disposed perpendicular to the earth's "true" north/south axis. An appropriate support for the tilted box may also include a mirror disposed beneath the scale face to permit easy viewing of the illuminated scale. An alternative embodiment comprises disposing the translucent scale face at the center of the box perpendicular to the slotted face and with the outer opposite parallel faces omitted to permit viewing of the illuminated scale face which is marked with a radial time index. This box may be adjustably mounted upon a suitable support to permit its proper orientation with regard to latitude and with an appropriate shade to overcome problems caused by seasonal variations in the position of the sun. A further embodiment combines features of the other embodiments.

10 Claims, 9 Drawing Figures

Fig. 1.
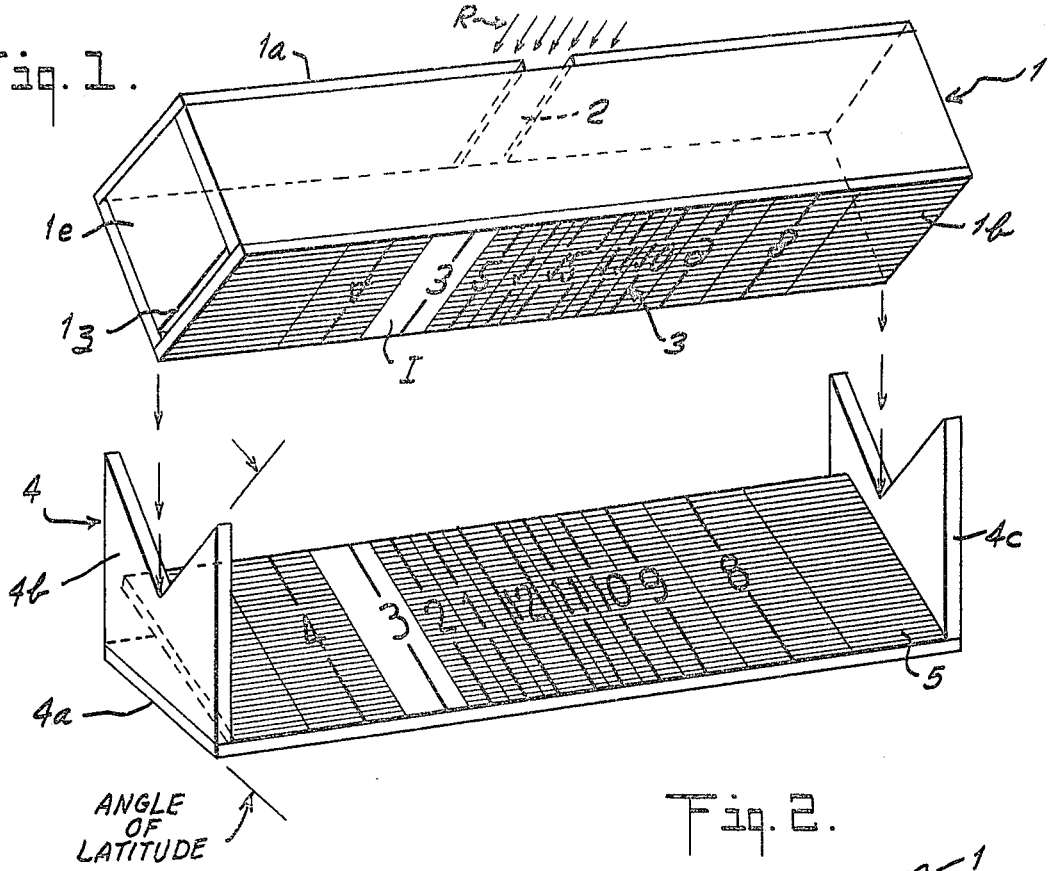
Fig. 2.
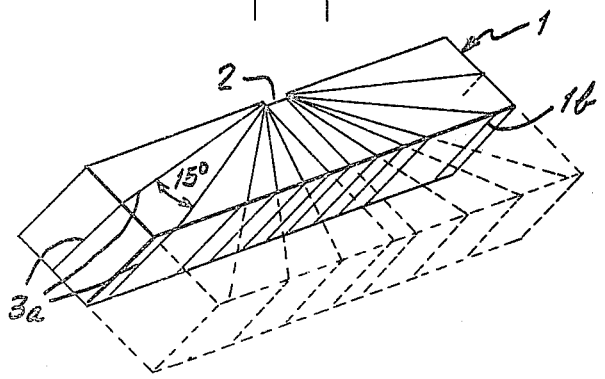
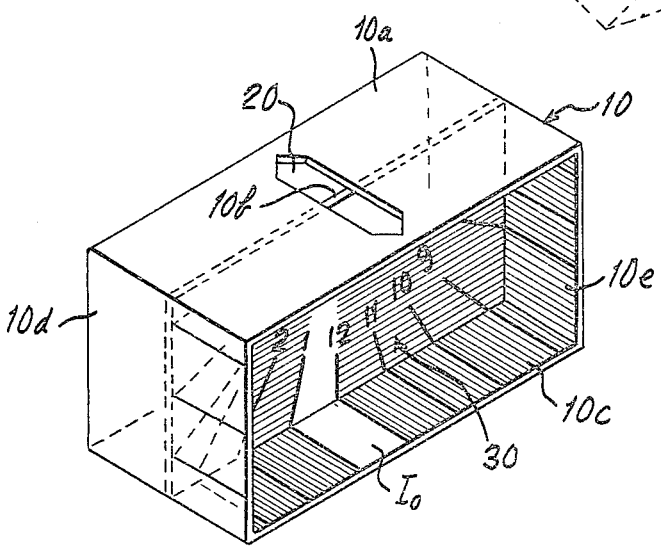
Fig. 3.

SUN CLOCK

BACKGROUND OF THE INVENTION

The present invention relates to the art of indicating time using the position of the sun and more particularly to an improved method and means for producing an indication of solar time using the contrast between an illuminated line, formed by sunlight passing through a flat slotted opaque surface, and a darker background on another flat surface.

Horological devices using the position of the sun in the sky have been known since ancient times and have generally involved some means for casting a shadow whose position on a scale provides an indication of the time. Various instruments for this purpose have taken many forms from the simple sundial with its triangular shadow casting member disposed on a circular time-indexed base to more structurally complicated and sophisticated solar clocks such as disclosed in U.S. Pat. No. 3,486,234 to Waterman and U.S. Pat. No. 3,786,570 to Davies.

The present invention presents a simplified method and means for indicating solar time incorporated in a box-like sun clock which may be constructed in various forms to present an illuminated line on a darker background time indication for viewing both indoors and outdoors.

SUMMARY OF THE INVENTION

The present invention embodies a method and means by which solar time can be determined through the imaging of an illuminated line of sunlight on a flat darker background. The sunlight is passed through a slot in a flat opaque member and imaged on a flat time-indicating member, which members are appropriately oriented with respect to each other and to latitute and the earth's "true" north/south axis. The slotted opaque member which may constitute one face of a rectangular box-like structure is disposed with respect to the sun at an angle corresponding to the latitude at which the clock is to be used, and the long axis of the box, or the short axis of the slot, is arranged perpendicular to the earth's "true" north/south axis. The sunlight passing through the slot is imaged as an illuminated line on the time-indicated member, which may have a translucent time index thereon and be the opposite box face parallel to the opaque member or an adjacent side face. Alternatively the time-indicating member may be disposed centrally in the box perpendicular to the opaque member and bisecting the slot. In the latter embodiment at least one adjacent side face of the box is omitted to permit viewing of the time-indicating member. In all the embodiments suitable support frames or stands may be used to mount the box in the proper position, and in certain embodiments the stand may also act as a sun shade. The position or size of the illuminated line may be used to indicate time, and a number of structural variations and features are disclosed within the scope of the invention.

BRIEF DESCRIPTION OF THE DRAWINGS

FIG. 1 is a perspective exploded view of one embodiment of a sun clock and a supporting stand in accordance with the present invention.

FIG. 2 is a diagrammatic view of the sun clock of FIG. 1 illustrating time index calibration for clocks of different proportions.

FIG. 3 is a perspective view of an alternate embodiment of a sun clock in accordance with the present invention.

DETAILED DESCRIPTION OF THE INVENTION

Figure 4:
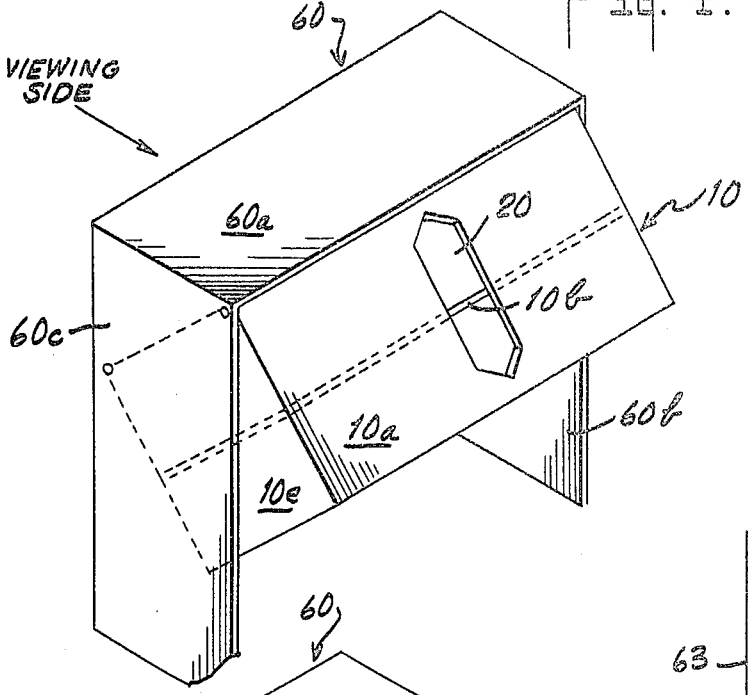
FIG. 4 is a perspective view of the sun clock of FIG. 3 mounted on an appropriate support frame.

One embodiment of sun clock in accordance with the present invention is shown in FIG. 1 and essentially comprises an elongated rectangular member or box 1, one of whose side faces 1*a* is opaque and provided with a centrally arranged slot 2. The box face 1*b*, disposed opposite face 1*a*, is translucent or has a translucent, proportionally expanded linear time index 3 formed thereon. The index or scale 3 is formed or calibrated in the manner of a polar sun dial as will be familiar to those skilled in the art and as explained, for example, in "Sundials' Their Theory and Construction," Chapter 9, pages 70–74, by Albert E. Waugh, Dover Publications, Inc., New York, 1973.

In operation, the parallel faces 1*a* and 1*b* are tilted at the angle of latitude of the site where the clock is to be used with slot 2 facing the sun, and the long axis of the box 1 is disposed perpendicular to the earth's "true" north/south axis. With the box 1 in this position the leading edge of the light image or line I formed by the sun's rays R passing through the slot 2 will indicate solar time along the time index 3. It will be seen that in comparison to known sun dials or clocks, the time will be indicated by an illuminated line on a flat darkened scale background.

An appropriate manner of disposing the sun clock at the proper orientation with regard to latitude and the earth's axis is by means of a support frame 4 in the form of a base member of flat stand 4*a* having upstanding end members 4*b* and 4*c*. As seen in FIG. 1, the end members 4*b* and 4*c* have their upper edges suitably cutout or bevelled to receive the end edges of box-like member 1. The surfaces of the cutout portions engaging the scale or display face 1*b* of box-like member 1 are arranged at an angle with the plane of the stand 4*a* corresponding to the appropriate angle of latitude at which the sun clock is to be used. If the clock scale 3 is to be viewed at or below eye level, a mirror 5 may be mounted on the support frame 4 adjacent and at an angle to the scale face 1*b* to reflect the time index therefrom. In such event the numerical indications on the time index 3 may be appropriately reversed as shown in the figure.

The box-like member 1 and support frame 4 may be constructed of a light plastic and, except for the slotted face 1*a* and the scale face 1*b*, the faces or parts may be either translucent or opaque. In addition to the time index lines on face 1*b*, hour lines 3*a* may be marked along the path of the rays on the other side faces and the end faces as well, in the manner shown in FIG. 2. It will also be seen with reference to FIG. 2 that the proportions of the box-like member 1 may be varied as desired but will require altering of the position of the hour lines on the appropriate faces. As illustrated in the figure, the time index on the various faces is determined by graphically extending rays every 15° from the edges of the slot 2. Where the graphic rays intersect the faces, such as display face 1*b*, the hour lines 3*a* are located. Subdivisions of the hours can be located on the index using the same method and subdividing the angles of the graphic rays. If every side of the box-like member 1 with the exception of the face 1*a* is made of translucent material, hour markings can be placed on five sides of the sun clock. Such an arrangement would permit reading of the clock from many directions.

In any event, irrespective of the materials and proportions, with this simple clock, as the sun moves across the sky, the slot will form a light image or line I at least on the translucent scale or display face 1*b*, the position of whose leading edge along the proportionately expanded numerical index 3 will accurately indicte solar time. The clock is suitable for use both indoors and outdoors.

An alternate embodiment of the sun clock of the present invention is shown in FIG. 3. In this embodiment the box-like member is modified by relocating the translucent-scale-containing face. More particularly, box-like member 10 has an opaque face 10*a* with an appropriate central slot 20 and the side faces adjacent face 10*a* are removed. A translucent-scale-containing face or display face 10*b* is centrally disposed within the box-like member 10 perpendicular to the slotted face 10*a*. In this instance a radial pattern of hour lines 30 is formed on the display face and the lines are arranged at the same angle as the graphic rays used in forming the linear scale in the first embodiment. Thus, the location of the hour markings on the display face with the present invention is a matter of choice, as they can be arranged as parallel lines as in the first embodiment, or radially as in this embodiment. In this embodiment the proportions of the clock have been altered to allow the inclusion of hour lines from 6 a.m. to 6 p.m. Parallel hour lines may also be marked on the bottom face 10*c* and end faces 10*d* and 10*e* and those faces made translucent. The slot 20 in opaque face 10*a* may be varied somewhat in configuration, while retaining its essential form with a long and a short axis, by pointing its opposite ends. As with the first embodiment, this alternate embodiment may be made in any suitable size and located both indoors and outdoors.

In operation, this embodiment is positioned in the same manner as the first embodiment to record solar time. As the sun moves across the sky, sun beams or rays of light will pass through the slot 20 and form an image $I_0$ on the display face 10*b* in the general form of the slot. This image rotates on the display face of the clock in accordance with the sun's movement. At a particular time the direction or angle of the ray image will coincide with a time line marked on the display face and will point to or illuminate the appropriate hour lines on the bottom or end face. As the day progresses, the changing width or shape of the beam image $I_0$ will provide a crude indication of the time as well, that is, the beam is widest at noon and narrowest at sunset or sunrise. It is contemplated that this changing width or shape of the beam image can be used with various calibrated mechanical or electronic systems to provide a time indication. As mentioned above, the proportions of the clock will be determinative of the appropriate scale proportions.

Figure 5:
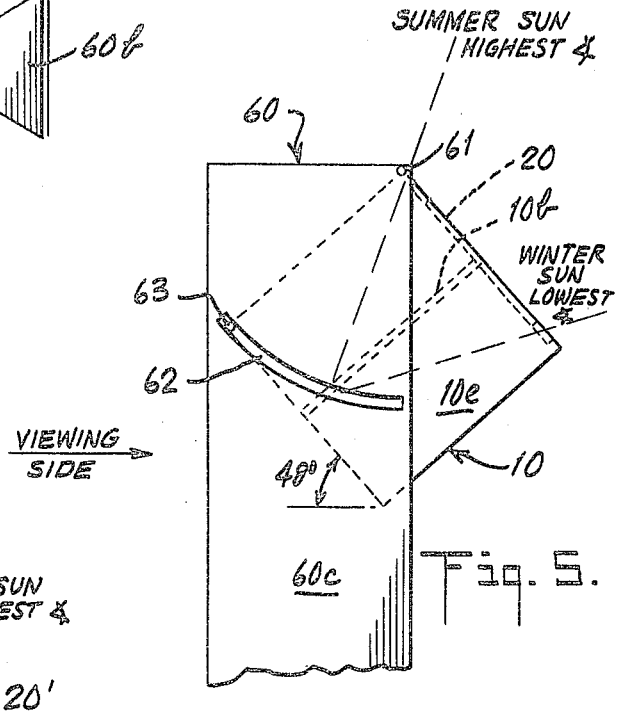
FIG. 5 is an elevational view of a sun clock of the type shown in FIG. 4 with the support frame modified for adjustability.

Provision may also be made for the seasonal variations in the sun's position. In particular, the beam image $I_0$ formed by the pointed slot 20 will vary throughout the year. During the winter months the sun is low in the sky, so that, as indicated in FIG. 5, sunlight entering the slot will intersect and backlight the display face 10*b*. In the summer months the sunlight will intersect the display face from the viewing side of the clock. At the time of the equinox on or about March 21 and September 23, the sun will enter the slot parallel to the display face, and, as a result, the face will remain unlit with only the bottom and end faces receiving light, so that the clock can thusly be used to signal the equinox.

The hour markings 30 on the relocated display face in this embodiment allow the display face 10*b* to be viewed without the assistance of a mirror as in the first embodiment. However, this relocation of the display face requires a further provision with this embodiment. Between March 21 and September 23 the sun rises north of each and sets north of west in the northern latitudes, so that during these months the sun will enter a properly positioned clock through the open viewing face as well as through the slot 20. This light is unwanted as it will obscure the sharp delineation of the bright beam image on the darker display face. Consequently, a sun shade may be provided whose primary function is to shade the clock face from low oblique sun rays during the early morning and late afternoon hours. Conveniently, the sun shade may be constructed as part of an adjustable stand for the clock and may be of a form such as support frame 60 in FIG. 4. The support frame 60 consists of an upper sun shade face 60*a* with upstanding support members 60*b* and 60*c* attached to its opposite ends. The box-like member 10 is disposed within the frame with the upper edge of the open viewing face abutting or attached to the rear edge of the sun shade face 60*a* and with the end faces 10*d* and 10*e* abutting or attached to the upstanding members 60*b* and 60*c*. The members 60*b* and 60*c* may be translucent to permit viewing of the display face through a wide range of angles, even though during a few weeks of the year around June 21 the early morning and late afternoon sunlight will pass through these members onto the display face. However, that amount of light will not obscure the sharp delineation of the beam image on the display face.

Figure 6:
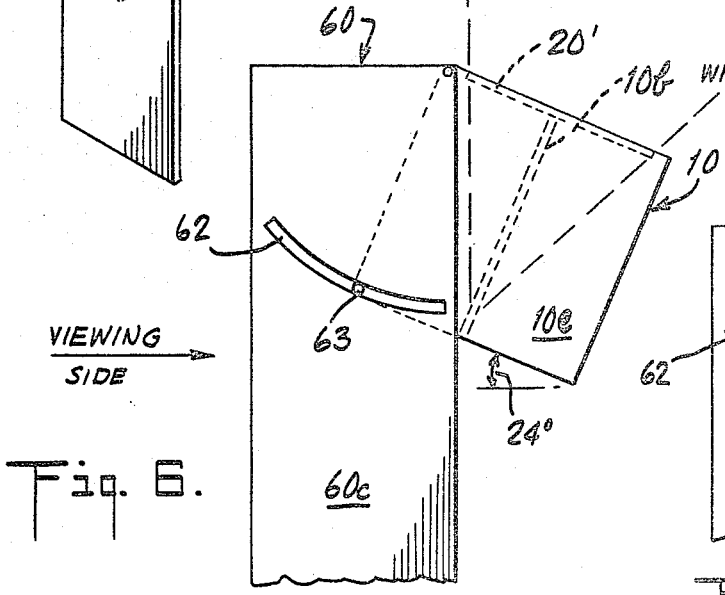
FIG. 6 is a view as in FIG. 5 showing the position of the clock adjusted for a different latitude and high and low angles of the sun.

As shown in FIGS. 5 and 6 box-like member 10 may be adjustably mounted on the support frame 60 by the use of a suitable hinge 61 which connects the upper edge of the slotted face 10*a* and the rear edge of the sun shade face 70*a* and by providing appropriate arcuate slots 62 in the upstanding members of the frame, which slots accommodate appropriate pin members 63 on the end faces of the box-like member. Appropriate stop means in the form, for example, of set screws may cooperate with the pin members 63 to set the box-like member 10 at the appropriate angle. Indoors a shading means will not be necessary, and the clock can be situated on an open stand similar to that used with the first embodiment.

Figure 7:
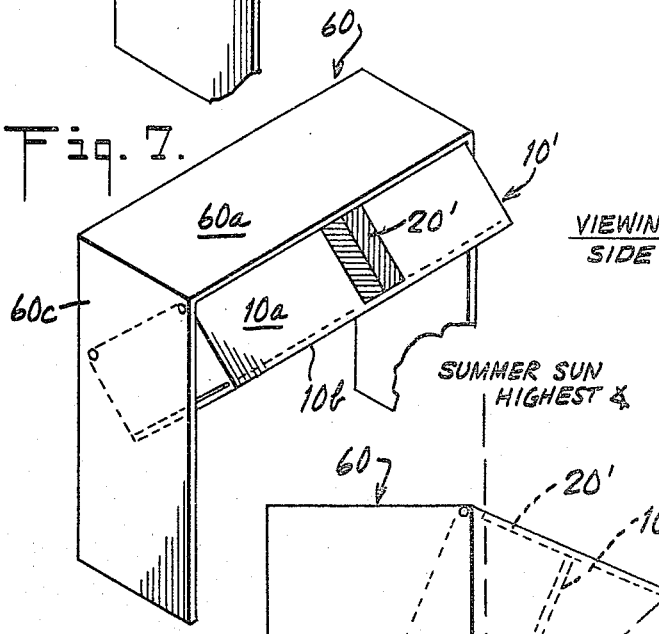
FIG. 7 is a view as in FIG. 4 illustrating a modification of the sun clock shown therein.
Figure 8:
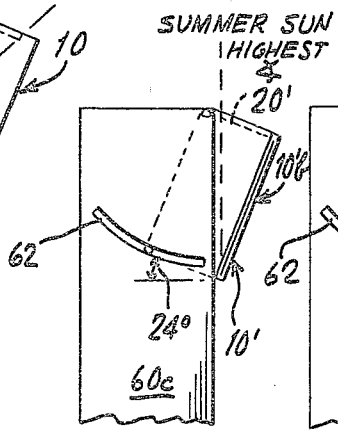
FIG. 8 is a view as in FIG. 5 showing the modified sun clock of FIG. 7 in a summer orientation.
Figure 9:
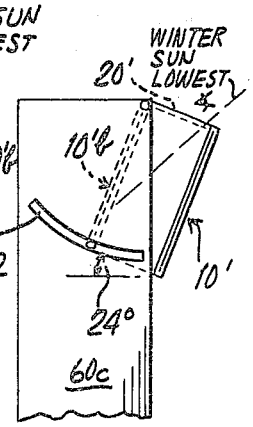
FIG. 9 is a view as in FIG. 5 showing a further modification of the sun clock of FIG. 7 in a winter orientation.

A further embodiment of the present invention modified to somewhat combine features of the two previous embodiments is shown in FIGS. 7–9. It will be seen that in this embodiment the centrally-located indicator face may be disposed on either edge of the box to accommodate it for use in different seasons. For example, from September through March the face 10'b is placed toward the viewing side (FIG. 9) so that it is back-lighted by the winter sun, while for the remainder of the year the face is located on the opposite side and front-lighted by the summer sun (FIG. 8). This change provides a suitable accommodation for the seasonal variations as described in connection with FIGS. 5 and 6. To this end the indicator face 10'b of the clock is adapted to be detachable such as by providing slots in one or both of the end faces of the box 10' through which the indicator face 10'b may be inserted and removed. This arrangement can perhaps be more clearly seen in FIG. 1 wherein a slot 1z is provided in face 1e to permit the insertion and removal of appropriate time index panels. In this manner, different display faces can be interchanged when desired to provide for different time changes such as daylight savings time and for different decorative patterns according to the season. Essentially in this embodiment it will be seen that the depth of the box as compared to that shown in FIG. 4 is reduced and grooves may be formed on the bottom and top faces to guide the display faces when being slid in and out of position.

An additional modification which may be included in any of the embodiments is the use of an insert piece 20' in the form of a bicolored rectangle of transparent plastic that fits into the slot of the various clock embodiments. This piece 20' will result in the projection of a bicolored beam from the light passing through the slot, with the border between the two colors of the beam bisecting the slot longitudinally forming a precise time indication.

It will be seen by those skilled in the art that the present invention will provide an indication of solar time both indoors and outdoors the year round unlike many prior art devices such as the typical indoor sun dial disclosed in the early U.S. Pat. No. 783,245 to Clarke wherein between the dates of March 21 and September 23 the sun would at times be inclined at such an angle that the line cast by the shadow cord would not always reach the display surface.

The term "translucent" as used herein is intended to refer to any structure which will pass light whether in an unobstructed manner as by voids, transparency or the like, or by reflection, refraction, or diffraction as long as some representation is presented to view on the opposite side of the structure from which the light is impinging.

I claim:

1. A sun clock comprising:

flat means for displaying a proportionately expanded linear time index;

box-like means supporting said displaying means and having a slot in one face thereof for imaging sun's rays in the form of a line of light on said displaying means, said displaying means comprising a translucent face of said box-like means disposed opposite said slotted face;

means for supporting said box like means with its long axis perpendicular to the earth's "true" north south axis and with its slotted face tilted at the angle of latitude, whereby the light line falling on said displaying means indicates solar time on said time index; and flat mirror means disposed adjacent and at an angle to said displaying means for reflecting an image of said time index and said light line thereon.

2. A sun clock comprising:

flat means for displaying a radial time index;

box-like means supporting said displaying means and having a slot with a long and short axis in one opaque face thereof for imaging the sun's rays in the form of a line of light on said displaying means, said displaying means comprising a face of said box-like means disposed perpendicularly adjacent said slotted face; and means for supporting said box-like means with the short axis of said slot perpendicular to the earth's "true" north/south axis and with its slotted face tilted at the angle of latitude, whereby the light line falling on said displaying means indicates solar time on said radial time index;

and wherein said displaying means is of a translucent material and said box-like means comprises means for supporting said displaying means along one side of said slotted face for back-lighting by the winter sun and along the opposite side of said slotted face for front-lighting by the summer sun.

3. A clock as in claim 2 wherein said supporting means comprises frame means for opaque material for adjustably supporting said box-like means thereon.

4. A method of indicating time by means of the sun comprising the steps of:

forming a slot with a long and short axis in a first flat member, said first flat member being of an opaque material;

disposing said first flat member in a plane at the angle of latitude and with the short axis of the slot in its face perpendicular to the earth's "true" north south axis;

attaching side members to the ends of said first flat member on opposite sides of said long axis of said slot;

supporting a second flat member adjacent and perpendicular to said first flat member and said side members to form a box-like structure and such that the sun's rays passing through the slot into the hollow interior of the box-like structure form a line of light upon said second flat member; and forming a radial time index on said second flat member such that the position of said light line thereon indicates solar time;

and wherein said second flat member is of a translucent material and is supported along one free side of said first flat member for back-lighting by the winter sun and is supported along the opposite free side of said first flat member for front-lighting by the summer sun.

5. A method as in claim 4 comprising the further step of inserting a transparent bicolored element in said slot.

6. A sun clock comprising:

flat imaging means of opaque material, having a slot formed therethrough with a long and a short axis for imaging the sun's rays passing therethrough as a line of light;

flat displaying means having a radial time index thereon and disposed adjacent and perpendicular to said flat imaging means; and means for alternately supporting said imaging and said displaying means with respect to each other in season such that said radial time index on said displaying means is back-lighted by the winter sun's rays passing through the slot and forming a light line thereon indicating solar time, and is front-lighted by the summer sun's rays passing through the slot and forming a light line thereon indicating solar time.

7. A clock as in claim 6 further comprising side members attached to said flat imaging means on opposite sides and parallel to the long axis of said slot and wherein said supporting means comprises slots in said end members into which said displaying means may be inserted and removed.

8. A clock as in claim 6 further comprising frame means of opaque material for mounting said imaging and displaying means, said frame means comprising two parallel spaced upstanding members with a cross member mounted on the upper ends of said upstanding members, and means for pivotally mounting said imaging and displaying means thereon.

9. A clock as in claim 8 wherein said flat imaging means is mounted on said frame means such that is lies in a plane disposed at the angle of latitude with the short axis of said slot perpendicular to the earth's "true" north/south axis.

10. A clock as in claim 6 further comprising a transparent bicolored insert piece disposed in the slot in said imaging means.

* * * * *

UNITED STATES PATENT AND TRADEMARK OFFICE

CERTIFICATE OF CORRECTION

PATENT NO. : 4,255,864

DATED : March 17, 1981

INVENTOR(S) : Scott R. Glendinning

It is certified that error appears in the above-identified patent and that said Letters Patent are hereby corrected as shown below:

Column 1, line 48 "time-indicated" should read --time indicating--.

Column 3, line 25 "indicte" should read --indicate--.

Column 5, line 64 "north south" should read --north/south--.

Column 6, line 26 "for" should read --of--.

Column 6, line 35 "north south" should read --north/south--.

Column 8, line 6 "is" , second occurrence, should read -- it --.

Signed and Sealed this

*Thirteenth* Day of *October 1981*

[SEAL]

*Attest:*

GERALD J. MOSSINGHOFF

*Attesting Officer*

*Commissioner of Patents and Trademarks*